US005950038A

United States Patent [19]

Okui

[11] Patent Number: 5,950,038

[45] Date of Patent: Sep. 7, 1999

[54] IMAGE FORMATION APPARATUS

[75] Inventor: Kiyoshi Okui, Mie, Japan

[73] Assignee: Kyocera Corporation, Kyoto, Japan

[21] Appl. No.: 09/031,322

[22] Filed: Feb. 26, 1998

[30] Foreign Application Priority Data

| | | | |
|---|---|---|---|
| Feb. 27, 1997 | [JP] | Japan | 9-059850 |
| Jun. 13, 1997 | [JP] | Japan | 9-173045 |
| Jun. 13, 1997 | [JP] | Japan | 9-187677 |

[51] Int. Cl.[6] ..... G03G 21/02

[52] U.S. Cl. ..... 399/43; 399/25

[58] Field of Search ..... 399/25–27, 38, 399/43

[56] References Cited

U.S. PATENT DOCUMENTS

| | | | |
|---|---|---|---|
| Re. 35,751 | 3/1998 | Midgley | 399/25 |
| 4,585,327 | 4/1986 | Suzuki . | |
| 4,771,313 | 9/1988 | Kuroda et al. . | |
| 4,774,544 | 9/1988 | Tsuchiya et al. . | |
| 4,851,875 | 7/1989 | Tanimoto . | |
| 4,961,088 | 10/1990 | Gilliland et al. . | |
| 5,008,711 | 4/1991 | Sakamoto et al. . | |
| 5,021,828 | 6/1991 | Yamaguchi et al. . | |
| 5,101,233 | 3/1992 | Ito et al. . | |
| 5,208,626 | 5/1993 | Tanimoto et al. . | |
| 5,220,379 | 6/1993 | Fukuchi et al. . | |
| 5,272,503 | 12/1993 | Lesueuer et al. . | |
| 5,452,059 | 9/1995 | Sekiya . | |
| 5,489,971 | 2/1996 | Nam . | |
| 5,572,292 | 11/1996 | Chatani et al. | 399/25 |

FOREIGN PATENT DOCUMENTS

| | | |
|---|---|---|
| 0 324 590 | 7/1989 | European Pat. Off. . |
| 58-195854 | 11/1983 | Japan . |
| 5-961854 | 4/1984 | Japan . |
| 61-147267 | 7/1986 | Japan . |

*Primary Examiner*—Richard Moses
*Attorney, Agent, or Firm*—Loeb & Loeb LLP

[57] ABSTRACT

An image formation apparatus which comprises a photosensitive unit 15 having a photosensitive body 14 and a device for acting on the photosensitive body 14, the photosensitive unit 15 being disposed detachably in the main body of the apparatus, and a main body controller 36 for controlling the operation of components for performing the image formation operation using the photosensitive body 14, the main body controller 36 having a main memory 40 for storing predetermined items. A recyclable substance is used for the photosensitive body 14 and the photosensitive unit 15 is provided with an auxiliary memory 17. The serial number of the main body of the apparatus and the total number of print sheets of paper counted since the main body of the apparatus was a new product are stored in the main memory 40 and the auxiliary memory 17. The cumulative number of print sheets of paper the photosensitive body 14 has printed is further stored in the auxiliary memory 17.

16 Claims, 10 Drawing Sheets

IMAGE FORMATION APPARATUS

BACKGROUND OF THE INVENTION

This invention relates to an image formation apparatus, such as a copier or a printer, and in particular to an image formation apparatus comprising a photosensitive unit containing a photosensitive body disposed detachably in the main body of the apparatus.

Conventional image formation apparatuses are described in Unexamined Japanese Patent Publications 59-61854 and 61-147267 and Postexamined Japanese Patent Publication 1-41987, for example. Each of the conventional image formation apparatuses comprises a unit comprising devices, such as a developing device, a cleaning device, and a charger placed surrounding a photosensitive body, integral with the photosensitive body, which will be hereinafter referred to as photosensitive unit, although the unit is called in different ways a process cartridge, a process unit, a process kit, or the like, the photosensitive unit being disposed detachably in the main body of the apparatus.

With the conventional image formation apparatus, the photosensitive unit at the end of its life is replaced with a new one, thereby maintaining the image quality. Various suggestions are made as to how to measure, display, and determine the rest of the life, how to prompt the user to replace the photosensitive unit, and the like.

By the way, in the conventional image formation apparatuses, the life of the photosensitive unit is set so that the photosensitive unit is replaced with the life of the photosensitive body as the reference, thus the photosensitive body in the old photosensitive unit removed by replacement is scheduled to be only discarded and is not intended to be recycled.

However, if the photosensitive body uses a long-life material such as amorphous silicon, even if the surface is scratched to some extent, the photosensitive body can be recycled for continuing use thereof.

To thus recycle the photosensitive body, it becomes necessary to manage the fact as to whether or not the photosensitive body in the photosensitive unit removed by replacement can be recycled and whether the photosensitive body in the photosensitive unit newly mounted by replacement is a brand-new or recycled product.

When the image formation apparatus itself guarantees a reasonable number of print sheets of paper, if a counter circuit of the main body of the apparatus or a main body controller having a memory storing the cumulative number of print sheets of paper is destroyed electrically, calculation for guaranteeing the number of print sheets of paper cannot be executed.

SUMMARY OF THE INVENTION

It is therefore an object of the invention to provide an image formation apparatus for facilitating management as to whether or not a photosensitive body in a photosensitive unit removed by replacement is still recyclable if a photosensitive body recycling system is adopted and enabling calculation for guaranteeing the number of print sheets of paper if a main body controller is electrically destroyed.

To the end, according to the first aspect of the invention, there is provided an image formation apparatus comprising a photosensitive unit having a photosensitive body and a device for acting on the photosensitive body, the photosensitive unit being disposed detachably in the main body of the apparatus, and a main body controller for controlling the operation of components for performing the image formation operation using the photosensitive body, the main body controller having a main memory for storing predetermined items, characterized in that a recyclable substance is used for the photosensitive body and the photosensitive unit has an auxiliary memory, and that a cumulative number of print sheets of paper the photosensitive body has printed and a total number of print sheets of paper counted since the main body of the apparatus was a new product are stored in the main memory and the auxiliary memory.

According to the image formation apparatus having the configuration, the cumulative number of print sheets of paper the photosensitive body has printed is stored in the auxiliary memory of the photosensitive unit, so that the auxiliary memory of the photosensitive unit removed by replacement is read and whether or not the photosensitive body in the photosensitive unit is still recyclable can be easily determined based on the cumulative number of print sheets of paper the photosensitive body has printed.

Even if the main body controller is electrically destroyed, the total number of print sheets of paper counted since the main body of the apparatus was a new product is also stored in the auxiliary memory of the photosensitive unit and thus is stored in the main memory of a new main body controller mounted by replacement, whereby calculation for guaranteeing the number of print sheets of paper can be executed although the main body controller is replaced.

Further, since the cumulative number of print sheets of paper the photosensitive body has printed and the total number of print sheets of paper counted since the main body of the apparatus was a new product are stored in the main memory of the main body controller, they can also be stored in the auxiliary memory to a new photosensitive unit mounted by replacement.

Furthermore, according to the second aspect of the invention, there is provided an image formation apparatus comprising a photosensitive unit having a photosensitive body and a device for acting on the photosensitive body, the photosensitive unit being disposed detachably in the main body of the apparatus, and a main body controller for controlling the operation of components for performing the image formation operation using the photosensitive body, the main body controller having a main memory for storing predetermined items, characterized in that a recyclable substance is used for the photosensitive body and the photosensitive unit is provided with an auxiliary memory, that an identification of the main body of the apparatus and the total number of print sheets of paper counted since the main body of the apparatus was a new product are stored in the main memory and the auxiliary memory, and that the cumulative number of print sheets of paper the photosensitive body has printed is further stored in the auxiliary memory.

According to the image formation apparatus having the configuration, the cumulative number of print sheets of paper the photosensitive body has printed is stored in the auxiliary memory of the photosensitive unit, so that the auxiliary memory of the photosensitive unit removed by replacement is read and whether or not the photosensitive body in the photosensitive unit is still recyclable can be easily determined based on the cumulative number of print sheets of paper the photosensitive body has printed.

Even if the main body controller is electrically destroyed, the total number of print sheets of paper counted since the main body of the apparatus was a new product is also stored in the auxiliary memory of the photosensitive unit and thus is stored in the main memory of a new main body controller mounted by replacement, whereby calculation for guaranteeing the number of print sheets of paper can be executed although the main body controller is replaced.

Further, since the identification of the main body of the apparatus and the total number of print sheets of paper counted since the main body of the apparatus was a new product are stored in the main memory of the main body controller, they can also be stored in the auxiliary memory to a new photosensitive unit mounted by replacement.

Furthermore, according to the third aspect of the invention, there is provided an image formation apparatus comprising a photosensitive unit having a photosensitive body and a device for acting on the photosensitive body, the photosensitive unit being disposed detachably in a main body of the apparatus, an image formation unit being disposed detachably in the main body of the apparatus for performing the image formation operation together with the photosensitive unit, and a main body controller for controlling the operation of components for performing the image formation operation using the photosensitive unit and the image formation unit, the main body controller having a main memory for storing predetermined items, in that a recyclable substance is used for the photosensitive body, that the photosensitive unit is provided with an auxiliary memory, that an identification of the main body of the apparatus and a value resulting from incrementing the total number of print sheets of paper counted since the main body of the apparatus was a new product each time a sheet of paper is printed are stored in the main memory and the auxiliary memory, that a value resulting from incrementing the cumulative number of print sheets of paper the photosensitive body has printed is stored in the auxiliary memory, and that a value resulting from incrementing the time or the number of print sheets using the image formation unit each time a sheet of paper is printed is stored in the main memory to measure a life of the image formation unit.

According to the image formation apparatus having the configuration, the value resulting from incrementing the cumulative number of print sheets of paper the photosensitive body has printed is stored in the auxiliary memory of the photosensitive unit, so that the stored value in the auxiliary memory of the photosensitive unit removed by replacement is read and whether or not the photosensitive body in the photosensitive unit is still recyclable can be easily determined based on the cumulative number of print sheets of paper the photosensitive body has printed.

Even if the main body controller is electrically destroyed, the value resulting from incrementing the total number of print sheets of paper counted since the main body of the apparatus was a new product each time a sheet of paper is printed is also stored in the auxiliary memory of the photosensitive unit and thus is stored in the main memory of a new main body controller mounted by replacement, whereby calculation for guaranteeing the number of print sheets of paper counted since the main body of the apparatus was a new product can be executed although the main body controller is replaced.

Since the identification of the main body of the apparatus and the value resulting from incrementing the total number of print sheets of paper counted since the main body of the apparatus was a new product each time a sheet of paper is printed are stored in the main memory of the main body controller, they can also be stored in the auxiliary memory of a new photosensitive unit mounted by replacement.

Further, when the image formation unit other than the photosensitive unit is replaced with a new product, the total number of print sheets counted so far since the main body of the apparatus was a new product is stored in the auxiliary memory of the photosensitive unit as a constant value not incremented as the later printing is performed. Thus, if the main body controller is replaced with a new one and the value of the number of print sheets using the image formation unit stored in the auxiliary memory is lost, the number of print sheets using the image formation unit after the replacement is calculated as the difference between the value resulting from incrementing the total number of print sheets of paper counted since the main body of the apparatus was a new product each time a sheet of paper is printed and the constant value of the total number of print sheets counted since the main body of the apparatus was a new product at the replacement time of the image formation unit and the difference is written into the main memory of the new main body controller, whereby the value resulting from incrementing the number of print sheets using the image formation unit each time a sheet of paper is printed can be restored and life management of the image formation unit can be continued.

DETAILED DESCRIPTION OF THE PREFERRED EMBODIMENTS

Referring now to the accompanying drawings, there are shown preferred embodiments of the invention.

First Embodiment

FIGS. 1 to 5 are drawings to show a printer according to a first embodiment of an image formation apparatus according to the invention.

Figure 1:
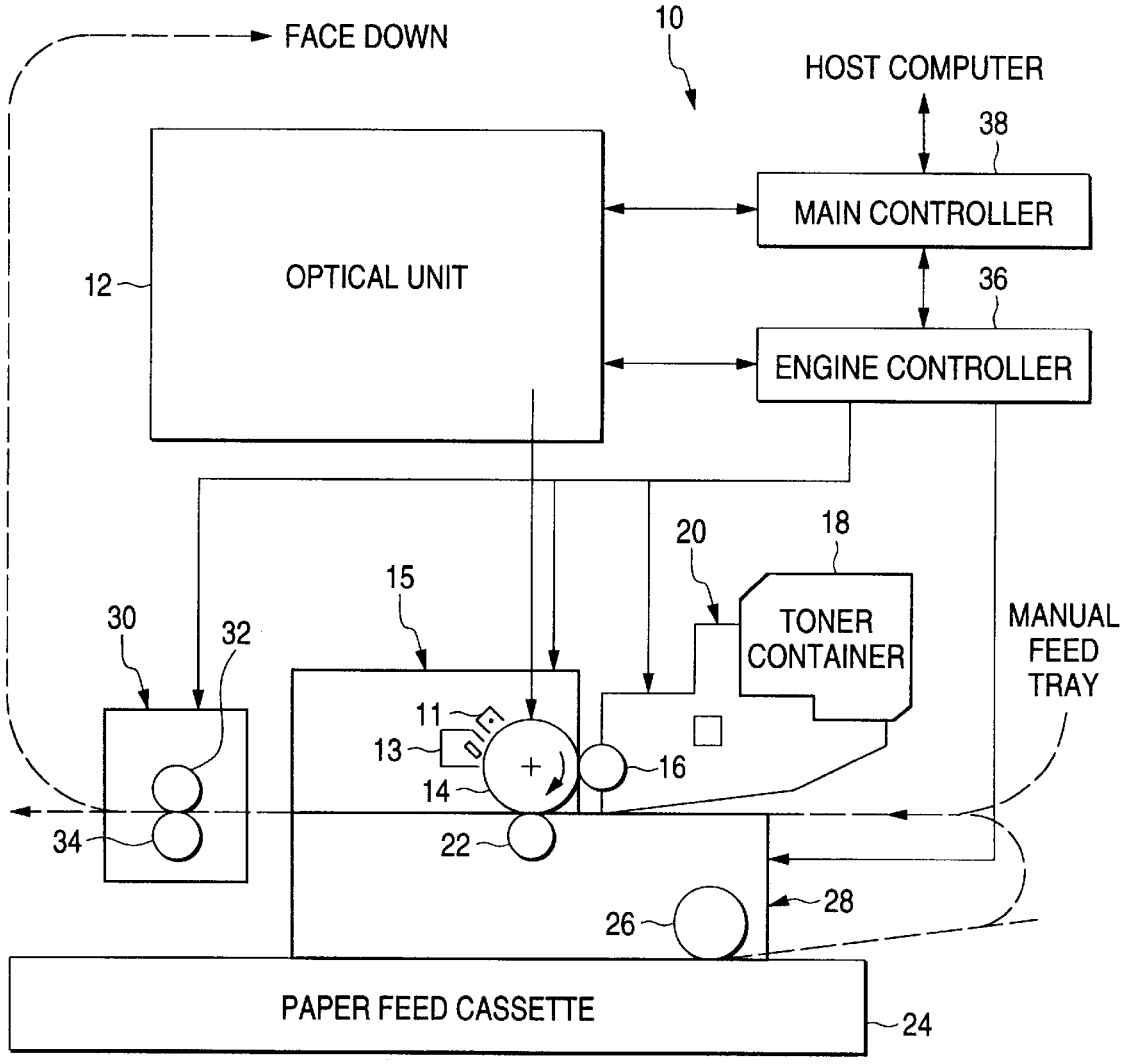
FIG. 1 is a schematic block diagram of a printer which is an image formation apparatus according to the invention.

In a printer 10 shown in FIG. 1, a drum 14 (photosensitive body) is charged uniformly by a main charger 11 of a drum unit (photosensitive unit) 15, then is exposed and scanned by an optical unit 12, forming an electrostatic latent image on the drum 14. While the drum 14 is rotated, the electrostatic latent image is developed by a developing roller 16. The developing roller 16 is disposed in a developing unit 20 and uses toner powder supplied from a toner container 18 of the developing unit 20 to develop the electrostatic latent image.

The drum 14 is further rotated, whereby the developed toner image is transferred to transfer paper passed between the drum 14 and a transfer roller 22. Transfer paper, which is stored in a paper feed cassette 24, is taken out by a paper feed roller 26 of a paper feed unit 28 and is transported to and passed through the space between the drum 14 and the transfer roller 22. Alternatively, transfer paper is supplied from a manual feed tray disposed corresponding to a side opening of the main body of the apparatus and is transported to and passed through the space between the drum 14 and the transfer roller 22.

The transfer paper to which the toner image is transferred by the drum 14 and the transfer roller 22 is then sent to a fixing unit 30 and is passed through the space between a heat roller 32 and a press roller 34, thereby fixing the toner powder forming the transferred toner image. Then, the transfer paper is discharged.

The transfer paper discharging way is a face-up way discharging transfer paper with the print face up and a face-down way discharging transfer paper with it turned upside down (the print face down), either of which can be selected as desired.

The optical unit 12, the drum unit 15, the developing unit 20, the paper feed unit 28, and the fixing unit 30 perform the image formation operation under the control of an engine controller (main body controller) 36. The engine controller 36 performs the control operation upon reception of a command from a host computer such as a personal computer or a wordprocessor via a main controller board 38. The optical unit 12 inputs image data from the host computer via the main controller board 38.

By the way, the drum unit 15 is disposed detachably in the main body of the apparatus so that it can be detached together with the drum 14, the main charger 11, a cleaning unit 13, and other attached devices (not shown) from the maim body of the apparatus if necessary. Therefore, when the drum 14 in the drum unit 15 guarantees a predetermined number of print sheets of paper, for example, 3,000,000 sheets of paper, if the drum 14, etc., is scratched, the drum unit 15 is removed and the drum 14 can be replaced easily.

Figure 2:
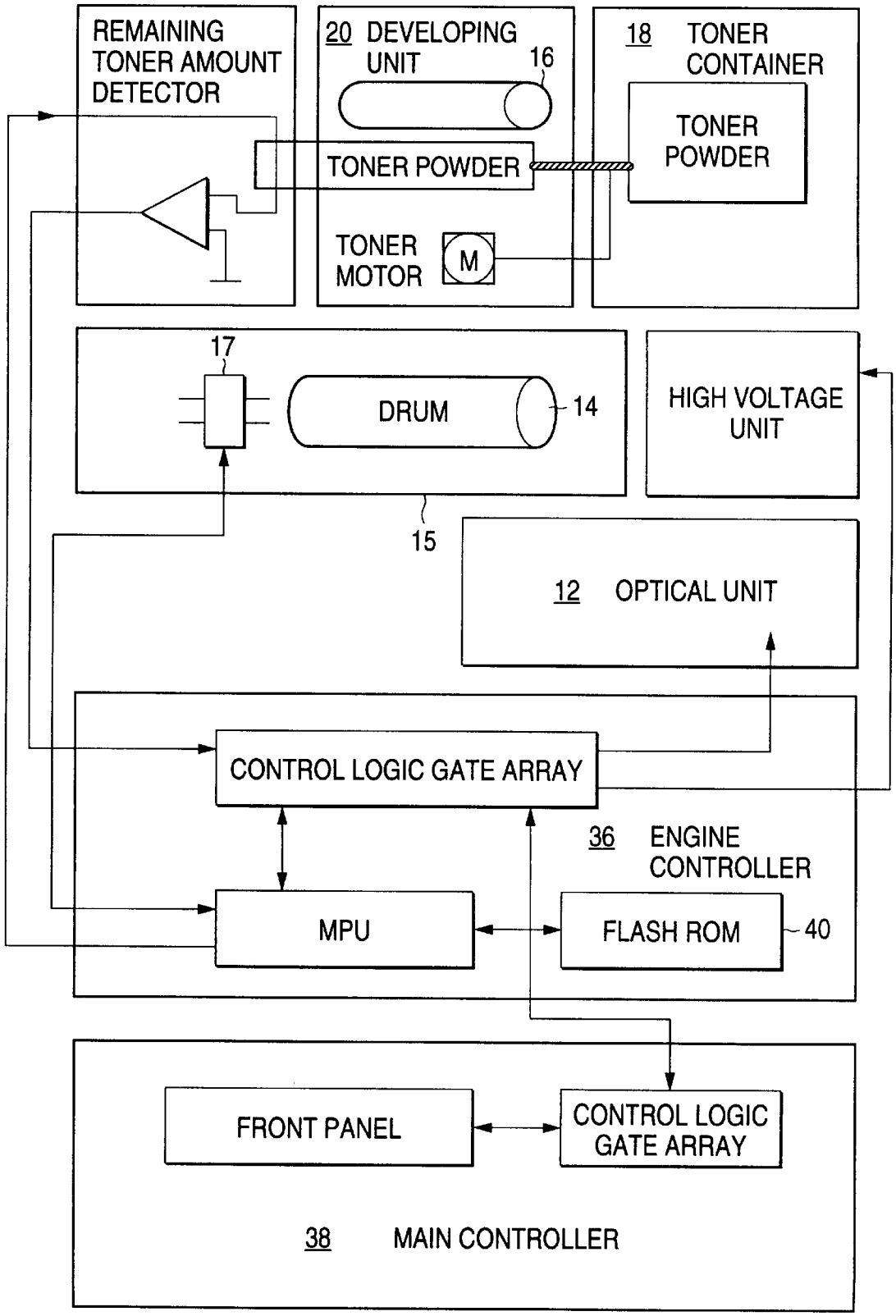
FIG. 2 is a block circuit diagram to show the circuit configuration of the printer in FIG. 1.
Figure 4:
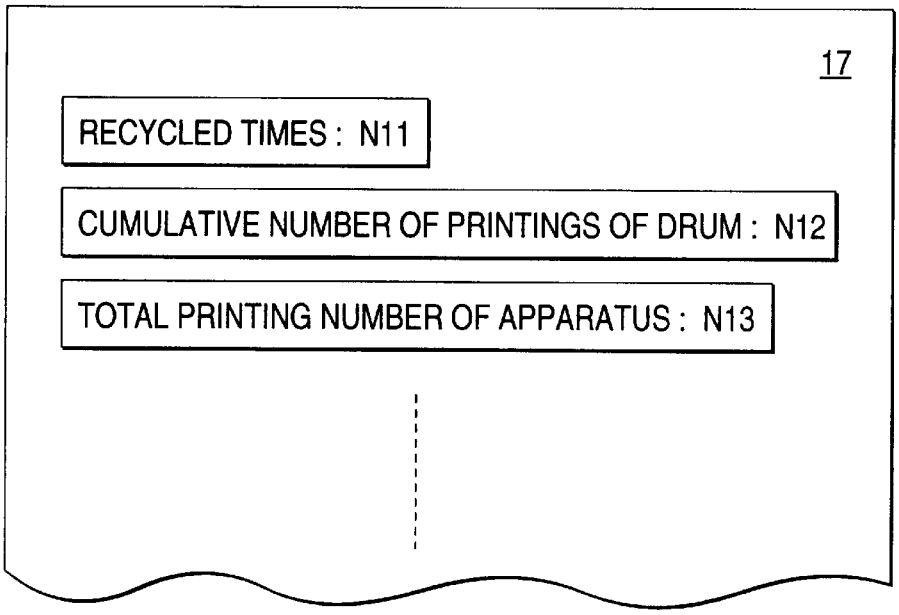
FIG. 4 is a drawing to schematically show the storage contents of an auxiliary memory of a drum unit according to the first embodiment.

FIG. 2 is a block circuit diagram of the image formation apparatus. The drum unit 15 comprises a programmable auxiliary memory 17 such as an EEPROM for storing N11 indicating the number of times the drum 14 has been recycled, N12 indicating the cumulative number of print sheets the drum 14 has printed, and N13 indicating the total number of print sheets counted since the main body of the apparatus was a new product, as shown in FIG. 4.

Figure 5:
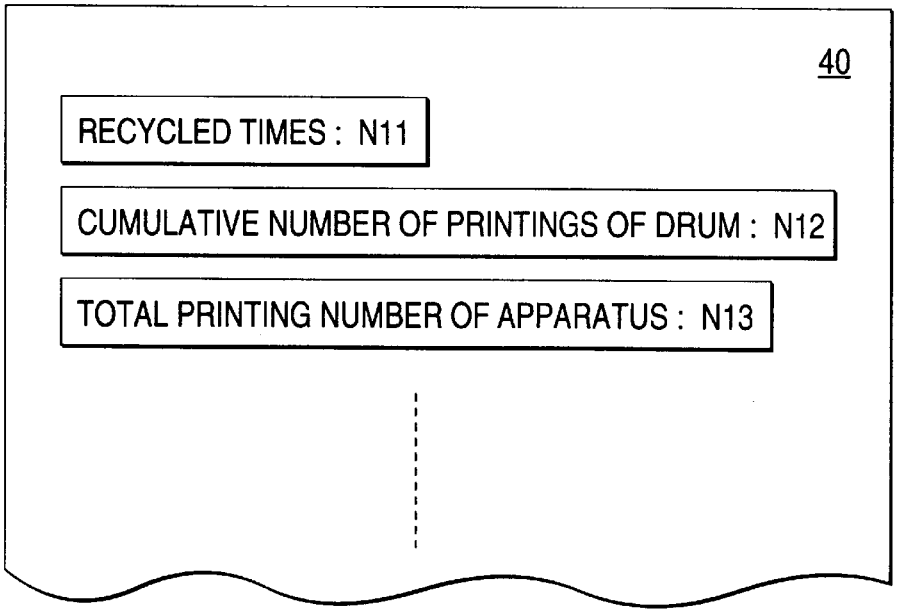
FIG. 5 is a drawing to schematically show the storage contents of a flash ROM in an engine controller according to the first embodiment.

The engine controller 36 comprises an MPU (microprocessing unit) and a control logic gate array used for the control operation and a rewritable flash ROM 40 (main memory). Like the auxiliary memory 17 to the drum unit 15, the flash ROM 40 in the engine controller 36 also stores N11 indicating the number of times the drum 14 has been recycled, N12 indicating the cumulative number of print sheets the drum 14 has printed, and N13 indicating the total number of print sheets counted since the main body of the apparatus was a new product, as shown in FIG. 5.

If the drum unit 15 is replaced with another drum unit 15 for some reason, the total number of print sheets counted since the main body of the apparatus was a new product stored in the flash ROM 40 in the engine controller 36 is written into the auxiliary memory 17 to the newly mounted drum unit 15.

If the engine controller 36 is replaced with another engine controller for some reason, the cumulative number of print sheets the drum 14 has printed and the total number of print sheets counted since the main body of the apparatus was a new product, stored in the auxiliary memory 17 of the drum unit 15 are written into the flash ROM 40 in the newly mounted engine controller 36.

Figure 3:
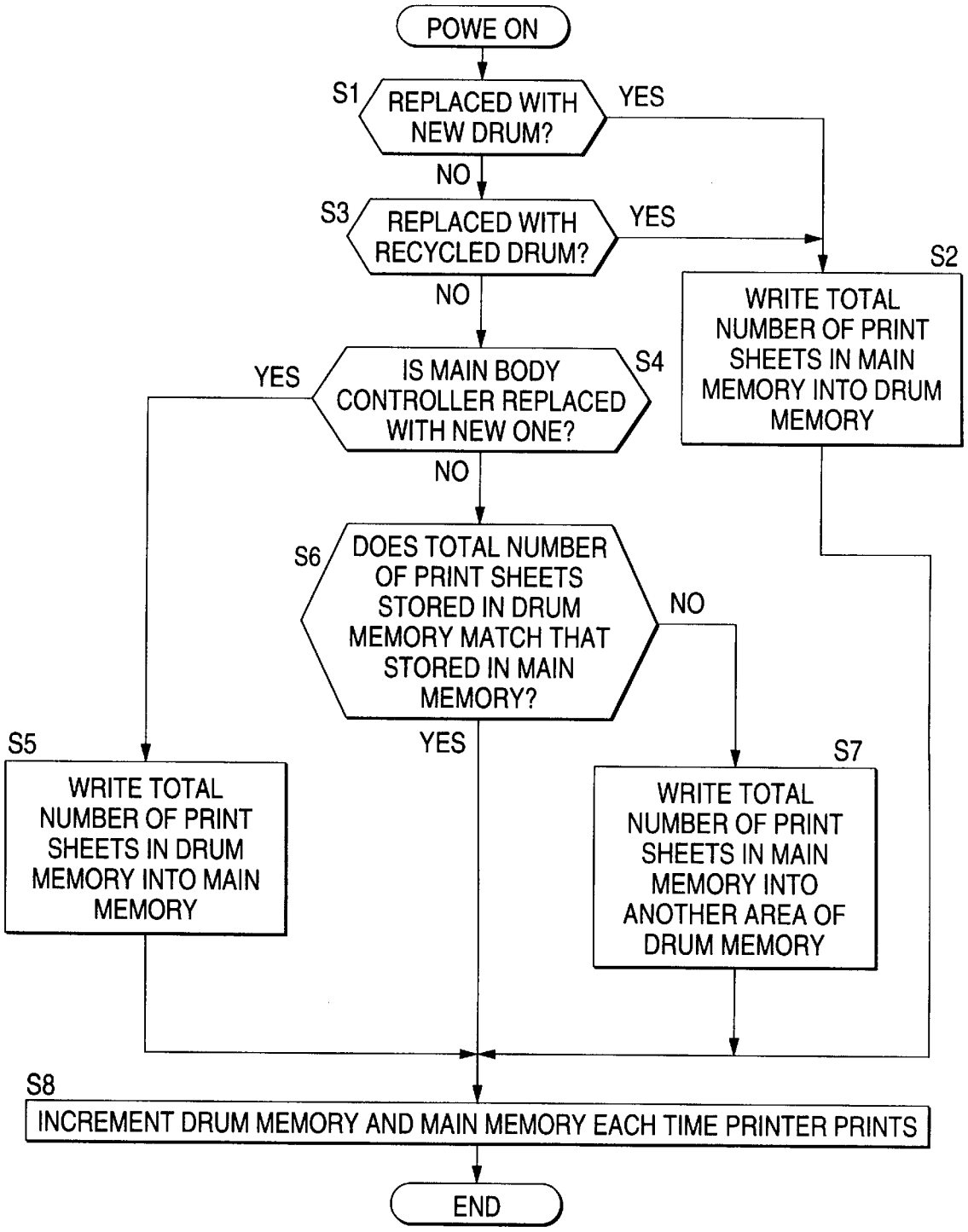
FIG. 3 is a flowchart to explain an operation sequence of the printer according to a first embodiment of the present invention.

Next, the operation of the printer 10 according to the embodiment will be discussed with reference to a flowchart of FIG. 3.

When power of the printer 10 is turned on, first the N12, the cumulative number of print sheets the drum 14 has printed, stored in the auxiliary memory 17 of the drum unit 15 (see FIG. 4) and the N12, the cumulative number of print sheets the drum 14 has printed, stored in the flash ROM 40 of the engine controller 36 (see FIG. 5) are read and compared. If the N12 in the auxiliary memory 17 is 00 and the N12 in the flash ROM 40 is not 00, it means that the drum unit 15 was replaced with a new one (YES at step S1).

In this case, N13, the total number of print sheets counted since the main body of the apparatus was a new product (see FIG. 5), is read from the flash ROM 40 and is written into the corresponding entry in the auxiliary memory 17 of the drum unit 15 at step S2, and the N12 in the flash ROM 40 is reset to 00.

Then, whenever the printer 10 prints a sheet of paper, the cumulative number of print sheets the drum 14 has printed and the total number of print sheets are incremented by one at step S8 and the results of incrementing the cumulative number of print sheets and the total number of print sheets are stored in the flash ROM 40 and the auxiliary memory 17.

If the N11, the number of times the drum 14 has been recycled, stored in the auxiliary memory 17 of the drum unit 15 (see FIG. 4) is not 00, it means that the drum unit 15 was replaced with a recycled one (YES at step S3). In this case, step S2 is executed.

If the drum unit 15 is not replaced and the engine controller 36 was replaced with a new one because of breakage, etc., (YES at step S4), the N13, the total number of print sheets counted since the main body of the apparatus was a new product, stored in the flash ROM 40 of the newly mounted engine controller 36 (see FIG. 5) is 00. Then, the N13, the total number of print sheets counted since the main body of the apparatus was a new product (see FIG. 4), is read from the auxiliary memory 17 and is written into the flash ROM 40 of the engine controller 36 to set the same value as the N13 stored in the auxiliary memory 17 at step S5.

If neither the drum unit 15 nor the engine controller 36 is replaced and the N13, the total number of print sheets of the main body of the apparatus, stored in the auxiliary memory 17 (see FIG. 4) does not match the N13, the total number of print sheets, stored in the flash ROM 40 at step S6, the N13, the total number of print sheets is read from the flash ROM 40 and is written into an empty area different from the storage area of the N13, the total number of print sheets, in the auxiliary memory 17 at step S7.

If such an event is repeated and the auxiliary memory fills with information, the information is rewritten in order starting at the oldest storage contents.

By the way, to replace the drum unit 15 with another one because of a scratch, etc., the cumulative number of print sheets the drum 14 has printed is stored in the auxiliary memory 17 to the drum unit 15 taken out from the main body of the apparatus. Thus, the number of print sheets is read and for example, if it is less than 50,000, the drum 14 can be recycled; if the number of print sheets is equal to or greater than 50,000, the drum 14 can be discarded.

As shown in FIG. 4, the N11, the number of times the drum 14 has been recycled, is stored in the auxiliary memory 17, so that recycling of the once recycled drum 14 can be stopped or that the once recycled drum 14 can be recycled more than once.

If the drum unit 15 is replaced, the cumulative number of print sheets the drum 14 has printed stored in the flash ROM 40 of the engine controller 36 is reset and is counted again starting at zero for storage.

If the drum unit 15 is provided with a plurality of the auxiliary memories 17 (at least three) and the same data is stored in the auxiliary memories 17, even if an overcurrent flows into one of the auxiliary memories 17 and the auxiliary memory 17 is broken while data is being written, accurate data can also be determined under majority rule of the auxiliary memories 17.

Although the number of sheets of paper, 50,000, is used as the determination criterion as to whether or not the drum 14 can be recycled in the embodiment, any other number of sheets of paper can also be used as the determination criterion, needless to say.

Further, the guaranteed number of sheets of paper is, for example, 500,000 in the embodiment, but need not be limited to 500,000, needless to say.

Second Embodiment

Figure 7:
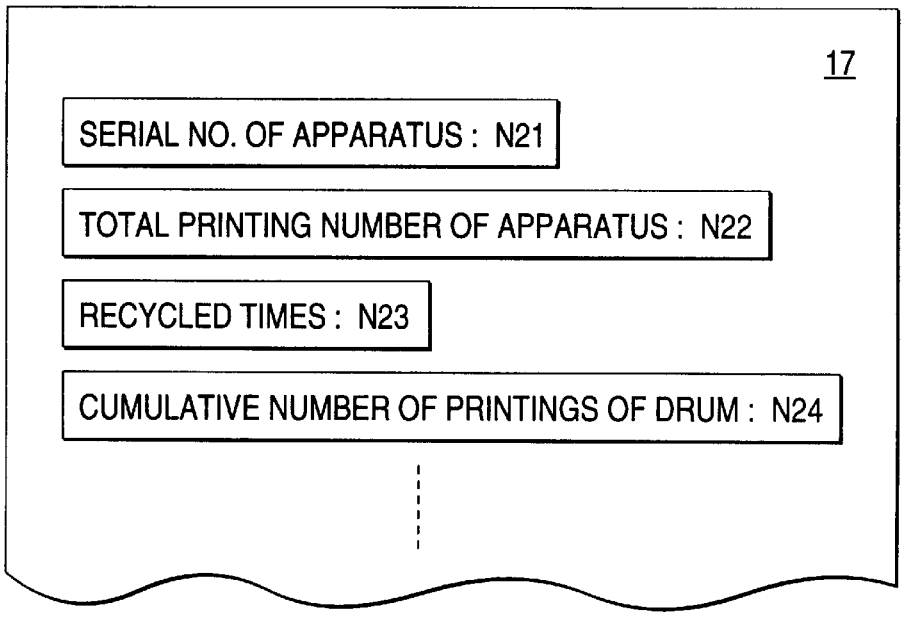
FIG. 7 is a drawing to schematically show the storage contents of an auxiliary memory of a drum unit according to the second embodiment.

A image formation apparatus of the second embodiment also has a configuration of the block circuit diagram shown in FIG. 2. The drum unit 15 comprises a programmable auxiliary memory 17 such as an EEPROM for storing N21 indicating the serial number of the main body of the apparatus (an identification of the main body of the apparatus such as the manufacturing number), N22 indicating the total number of print sheets counted since the main body of the apparatus was a new product, N23 indicating the number of times the drum 14 has been recycled, and N24 indicating the cumulative number of print sheets the drum 14 has printed, as shown in FIG. 7.

Figure 8:
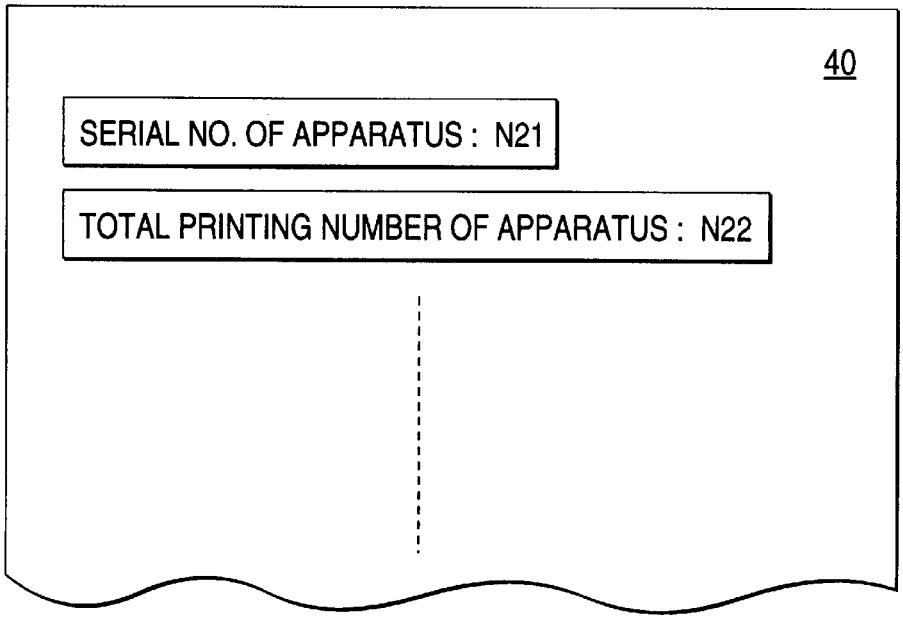
FIG. 8 is a drawing to schematically show the storage contents of a flash ROM in an engine controller according to the second embodiment.

The engine controller 36 comprises an MPU (microprocessing unit) and a control logic gate array used for the control operation and a rewritable flash ROM 40 (main memory). The flash ROM 40 in the engine controller 36 stores N21 indicating the serial number of the main body of the apparatus and N22 indicating the total number of print sheets counted since the main body of the apparatus was a new product, as shown in FIG. 8.

If the drum unit 15 is replaced with another drum unit 15 for some reason, N21 (the serial number of the main body of the apparatus) and N22 (the total number of print sheets counted since the main body of the apparatus was a new product) stored in the flash ROM 40 in the engine controller 36 are written into the auxiliary memory 17 of the newly mounted drum unit 15.

If the engine controller 36 is replaced with another engine controller 36 for some reason, N21 (the serial number of the main body of the apparatus) and N22 (the total number of print sheets counted since the main body of the apparatus was a new product) stored in the auxiliary memory 17 of the drum unit 15 are written into the flash ROM 40 in the newly mounted engine controller 36. N24 indicating the cumulative number of print sheets the drum 14 has printed can always be read.

Figure 6:
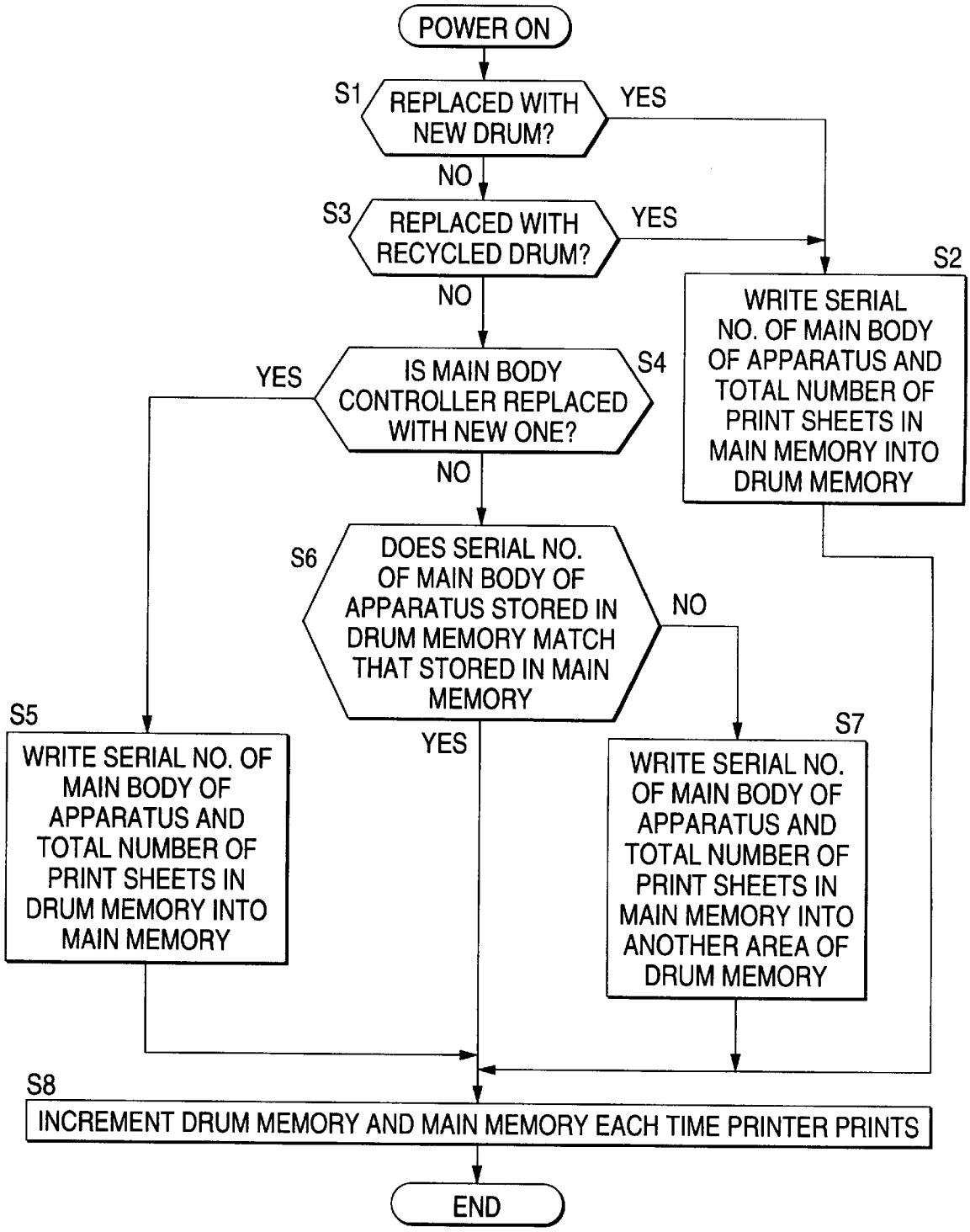
FIG. 6 is a flowchart to explain an operation sequence of the printer according to a second embodiment of the present invention.

Next, the operation of the printer 10 according to the second embodiment will be discussed with reference to a flowchart of FIG. 6.

When power of the printer 10 is turned on, first the engine controller 36 reads the N21, the serial number of the main body of the apparatus, stored in the auxiliary memory 17 of the drum unit 15 (see FIG. 7) and the N21, the serial number of the main body of the apparatus, stored in the flash ROM 40 of the engine controller 36 (see FIG. 8) and compares them. If the N21 in the auxiliary memory 17 is 00 and the N21 in the flash ROM 40 is not 00, it means that the drum unit 15 was replaced with a new one (YES at step S1).

In this case, the engine controller 36 reads the N21, the serial number of the main body of the apparatus, and N22, the total number of print sheets counted since the main body of the apparatus was a new product (see FIG. 8), from the flash ROM 40 and writes them into the corresponding entries in the auxiliary memory 17 of the drum unit 15 at step S2.

Then, whenever the printer 10 prints a sheet of paper, the engine controller 36 increments the N24, the cumulative number of print sheets the drum 14 has printed, and the N22, the total number of print sheets, by one at step S8 and stores the result of incrementing the N22 in the flash ROM 40 and the results of incrementing the N24 and the N22 in the auxiliary memory 17. Then, the process terminates.

If the N23, the number of times the drum 14 has been recycled, stored in the auxiliary memory 17 of the drum unit 15 (see FIG. 7) is not 00, it means that the drum unit 15 was replaced with a recycled one (YES at step S3). In this case, steps S2 and S8 are executed.

If the drum unit 15 is not replaced and the engine controller 36 was replaced with a new one because of breakage, etc., (YES at step S4), the N21, the serial number of the main body of the apparatus, stored in the flash ROM 40 of the newly mounted engine controller 36 (see FIG. 8) is 00. Then, the N21, the serial number of the main body of the apparatus, and N22, the total number of print sheets counted since the main body of the apparatus was a new product (see FIG. 7), are read from the auxiliary memory 17 and are written into the flash ROM 40 of the engine controller 36 to set the same values as the N21 and N22 stored in the auxiliary memory 17 at step S5.

If the N21, the serial number of the main body of the apparatus, stored in the auxiliary memory (see FIG. 7) does not match the N21, the serial number of the main body of the apparatus, stored in the flash ROM 40 (see FIG. 8) at step S6, the N21, the serial number of the main body of the apparatus, and the N22, the total number of print sheets, are read from the flash ROM 40 and are written into empty entries in the auxiliary memory 17 at step S7.

If such an event is repeated and the auxiliary memory fills with information, the information is rewritten in order starting at the oldest storage contents.

In doing so, if a drum unit 15 or an engine controller 36 of another printer 10 is inserted for some reason on the market, its history can be left in the auxiliary memory 17.

By the way, to replace the drum unit 15 with another one because of a scratch of the drum 14, etc., the cumulative number of print sheets the drum 14 has printed is stored in the auxiliary memory 17 to the drum unit 15 taken out from the main body of the apparatus. Thus, the number of print sheets is read and for example, if it is less than 50,000, the drum 14 can be recycled; if the number of print sheets is equal to or greater than 50,000, the drum 14 can be discarded.

As shown in FIG. 7, the N23, the number of times the drum 14 has been recycled, is stored in the auxiliary memory 17, so that recycling of the once recycled drum 14 can be stopped or that the once recycled drum 14 can be recycled more than once.

If the same data is stored in at least three entries or more in the auxiliary memory 17, even if power is turned off while data is being written and the data being written is broken, accurate data can also be determined under majority rule of the data pieces.

Although the number of sheets of paper, for example, 50,000, is used as the determination criterion as to whether or not the drum 14 can be recycled in the embodiment, any other number of sheets of paper can also be used as the determination criterion, needless to say.

Further, the guaranteed number of sheets of paper is, for example, 300,000 in the embodiment, but need not be limited to 300,000, needless to say.

Third Embodiment

Figure 9:
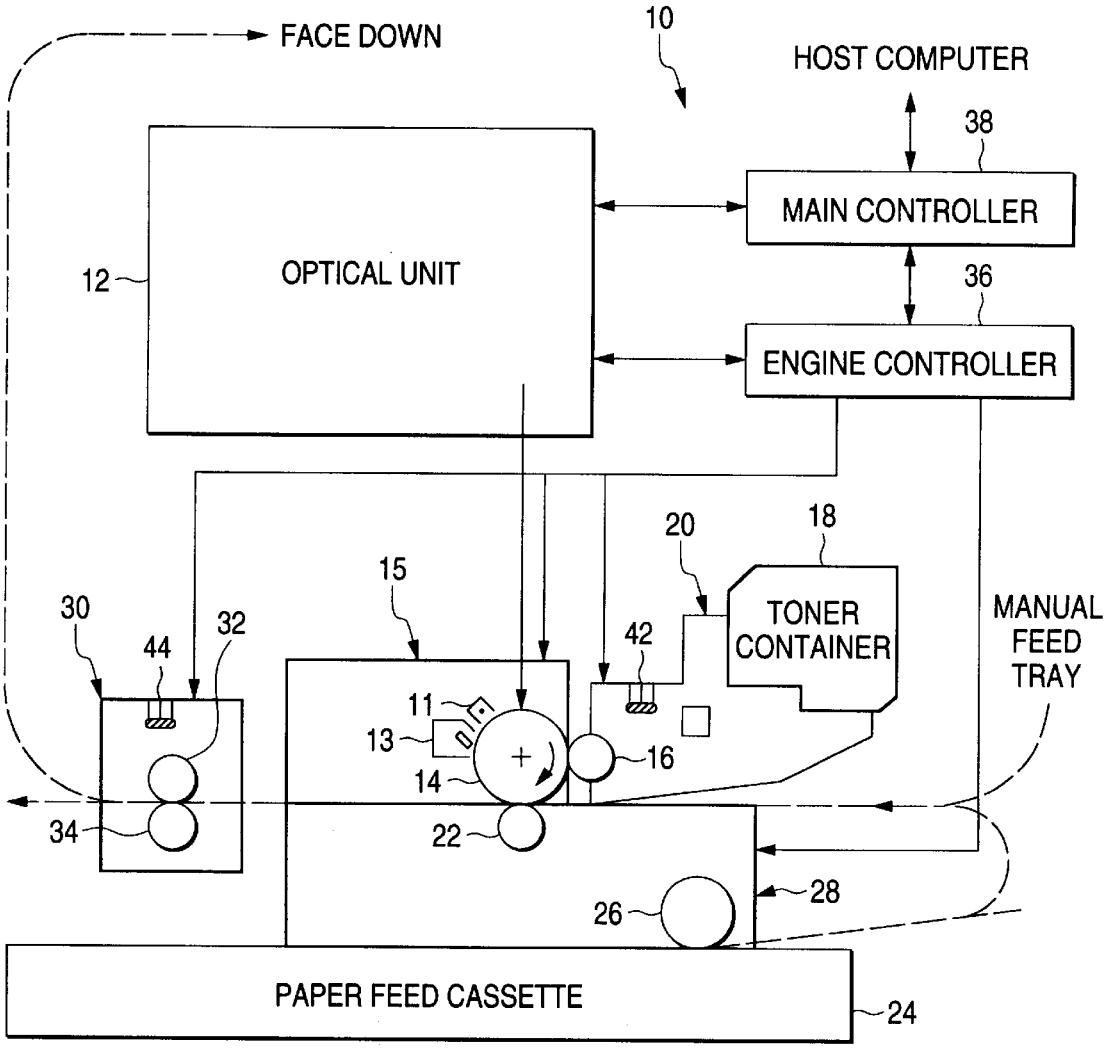
FIG. 9 is a schematic block diagram of a printer which is an image formation apparatus according to the third embodiment of the invention.

FIG. 9 is a schematic block diagram of a printer which is an image formation apparatus according to the third embodiment of the invention. According to the third embodiment, the developing unit 20 and the fixing unit 30, which are the image formation units for performing the image formation operation together with the drum unit 15, are also disposed detachably in the main body of the apparatus although they cannot be recycled. The developing unit 20 is provided with a life fuse 42 and the fixing unit 30 is provided with a life fuse 44.

Figure 10:
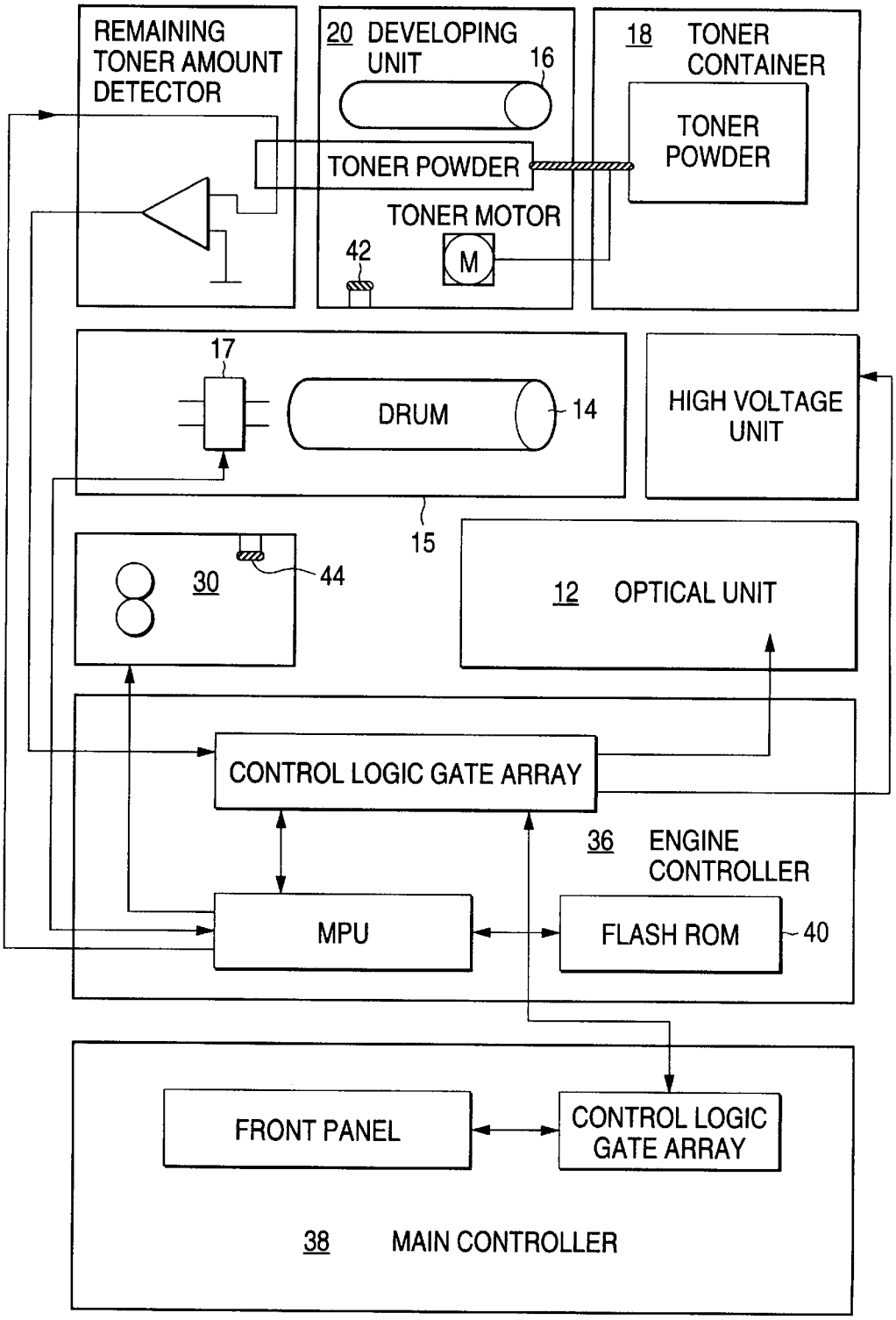
FIG. 10 is a block circuit diagram to show the circuit configuration of the printer in FIG. 9.
Figure 11:
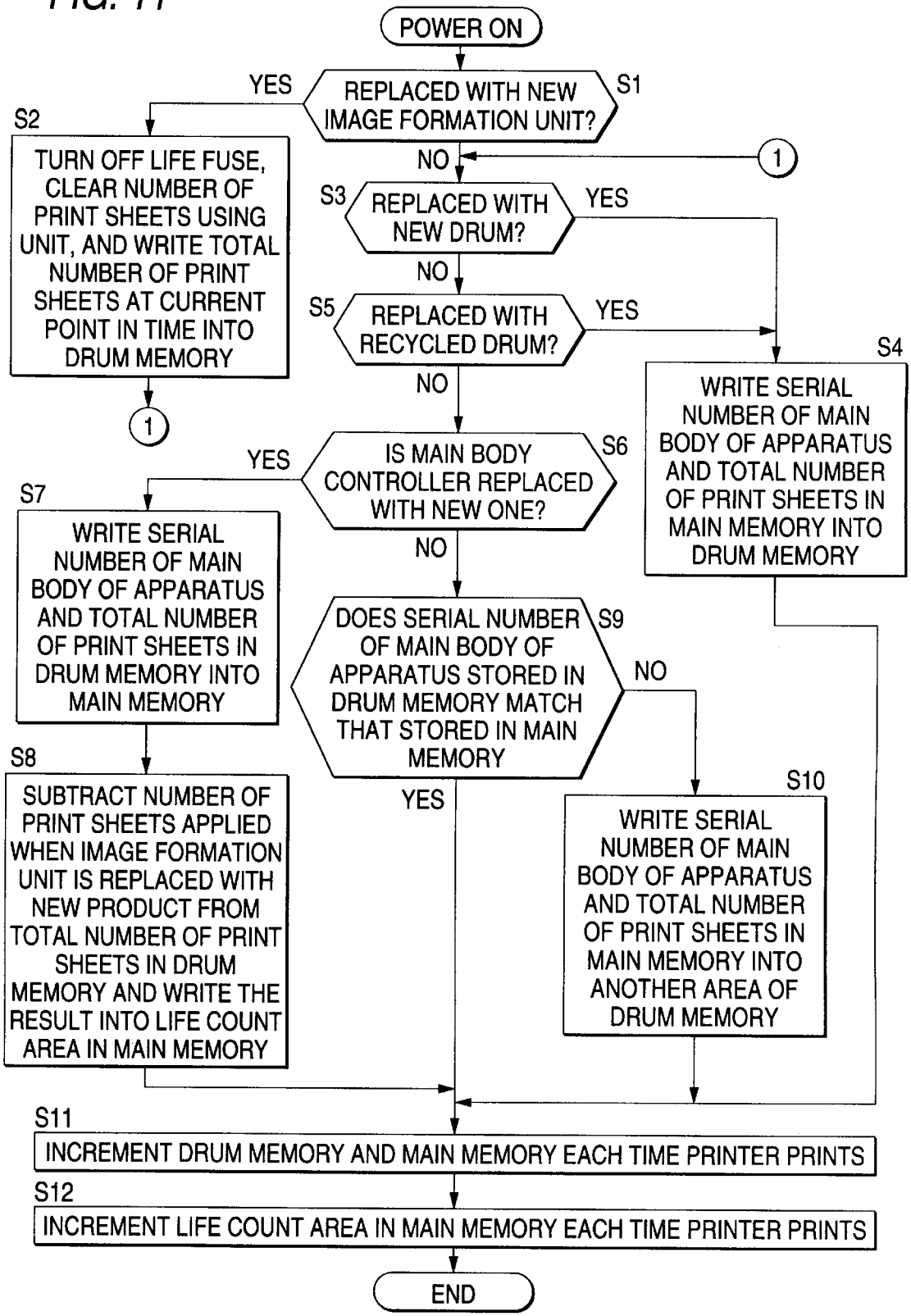
FIG. 11 is a flowchart to explain an operation sequence of the printer according to a third embodiment of the present invention.

FIG. 10 is a block circuit diagram of the image formation apparatus. The drum unit 15 comprises a programmable auxiliary memory 17 such as an EEPROM for storing N31 indicating the serial number of the main body of the apparatus (an identification of the main body of the apparatus such as the manufacturing number), N32 indicating the total number of print sheets counted since the main body of the apparatus was a new product, N33 indicating the total number of print sheets counted since the main body of the apparatus was a new product when the developing unit 20 is replaced with a new product, N34 indicating the total number of print sheets counted since the main body of the apparatus was a new product when the fixing unit 30 is replaced with a new product, N35 indicating the number of times the drum 14 has been recycled, and N36 indicating the cumulative number of print sheets the drum 14 has printed, as shown in FIG. 4.

The number of print sheets N32, N36 is incremented by one and is stored each time the printer 10 prints a sheet of paper; the number of print sheets N33, N34 is stored as a constant value not incremented each time the printer 10 prints a sheet of paper.

The engine controller 36 comprises an MPU (microprocessing unit) and a control logic gate array used for the control operation and a rewritable flash ROM 40 (main memory).

Figure 13:
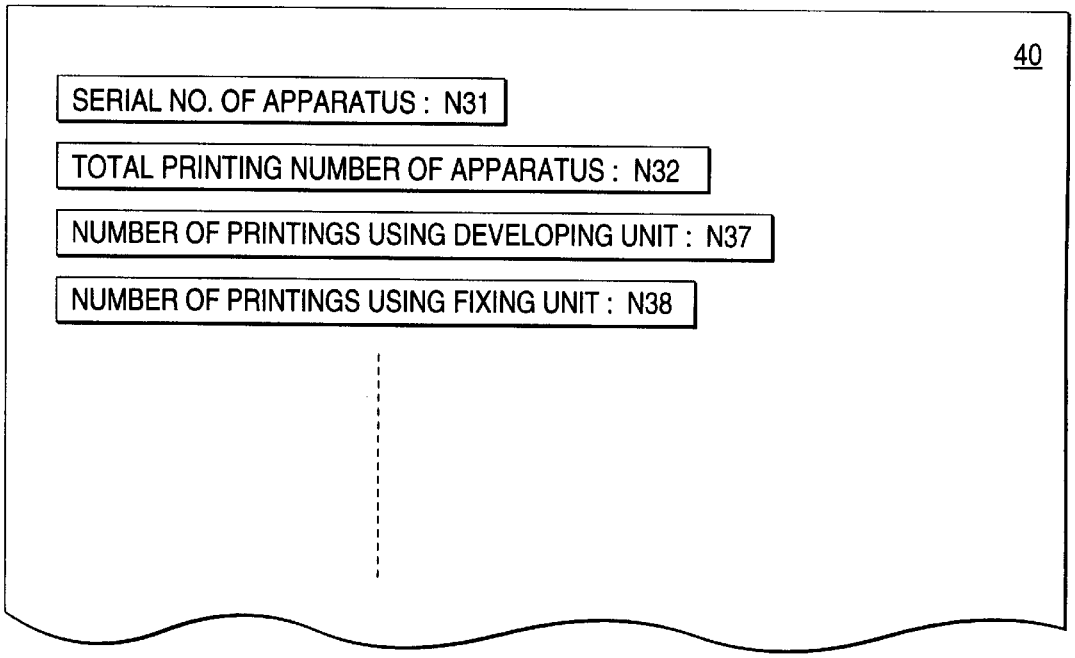
FIG. 13 is a drawing to schematically show the storage contents of a flash ROM in an engine controller according to the third embodiment.

The flash ROM 40 in the engine controller 36 stores N31 indicating the serial number of the main body of the apparatus, N32 indicating the total number of print sheets counted since the main body of the apparatus was a new product, N37 indicating the use time of the developing unit 20 or the number of print sheets using the developing unit 20 after replacement of developing unit (difference between N32 and N33), and N38 indicating the use time of the fixing unit 30 or the number of print sheets using the fixing unit 30 after replacement of fixing unit (difference between N32 and N34), as shown in FIG. 13.

The number of print sheets N32, N37, N38 is incremented each time the printer 10 prints a sheet of paper after the replacement.

If the drum unit 15 is replaced with another drum unit 15 for some reason, N31 (the serial number of the main body of the apparatus) and N32 (the total number of print sheets counted since the main body of the apparatus was a new product) stored in the flash ROM 40 in the engine controller 36 are written into the auxiliary memory 17 of the newly mounted drum unit 15.

If the engine controller 36 is replaced with another engine controller 36 for some reason, N31 (the serial number of the main body of the apparatus) and N32 (the total number of print sheets counted since the main body of the apparatus was a new product) stored in the auxiliary memory 17 of the drum unit 15 are written into the flash ROM 40 in the newly mounted engine controller 36. N36 indicating the cumulative number of print sheets the drum 14 has printed can always be read out.

Further, when the life fuse 42 or 44 placed in the developing unit 20 or the fixing unit 30 is brought into conduction, the MPU of the engine controller 36 assumes that the developing unit 20 or the fixing unit 30 is replaced with a new one, and turns off the life fuse 42 or 44.

At this time, N37 (the number of print sheets using the developing unit 20) and N38 (the number of print sheets using the fixing unit 30) stored in the flash ROM 40 are erased and N33 (the total number of print sheets counted since the main body of the apparatus was a new product when the developing unit 20 is replaced with a new product and N34 (the total number of print sheets counted since the main body of the apparatus was a new product when the fixing unit 30 is replaced with a new product) are stored in the auxiliary memory 17 for later storing the counts. The number of print sheets N33, N34 is stored as a constant value not incremented each time the printer 10 prints a sheet of paper.

Next, the operation of the printer 10 according to the embodiment will be discussed with reference to a flowchart of FIG. 10.

When power of the printer 10 is turned on, first whether or not the life fuse 42 or 44 placed in the developing unit 20 or the fixing unit 30 is conducting is checked. If the life fuse 42 (44) is conducting, it means that the developing unit 20 (the fixing unit 30) is replaced with a new product (YES at step S1).

In this case, the life fuse 42, 44 is turned off and N37 (the number of print sheets using the developing unit 20), N38 (the number of print sheets using the fixing unit 30) stored in the flash ROM 40 is erased and N33, N34 (the total number of print sheets counted since the main body of the apparatus was a new product) at the point in time is written into the auxiliary memory at step S2. The value N33, N34 is a constant value not incremented as the later printing is performed, as described above.

The engine controller 36 reads the N31, the serial number of the main body of the apparatus, stored in the auxiliary memory 17 of the drum unit 15 (see FIG. 12) and the N31, the serial number of the main body of the apparatus, stored in the flash ROM 40 of the engine controller 36 (see FIG. 13) and compares them. If the N31 in the auxiliary memory 17 is 00 and the N31 in the flash ROM 40 is not 00, it means that the drum unit 15 was replaced with a new one (YES at step S3).

In this case, the engine controller 36 reads the N31, the serial number of the main body of the apparatus, and N32, the total number of print sheets counted since the main body of the apparatus was a new product (see FIG. 13), from the flash ROM 40 and writes them into the corresponding entries in the auxiliary memory 17 of the drum unit 15 at step S4.

Then, whenever the printer 10 prints a sheet of paper, the engine controller 36 increments the N36, the cumulative number of print sheets the drum 14 has printed, and the N32, the total number of print sheets, by one at step S11, stores the result of incrementing the N32 in the flash ROM 40 and the auxiliary memory 17, increments the N37, the number of print sheets using the developing unit 20, and the N38, the number of print sheets using the fixing unit 30, stored in the flash ROM 40 by one at step S12, and stores the result of incrementing the N36, the cumulative number of print sheets the drum 14 has printed stored in the auxiliary memory 17. Then, the process terminates.

If the N35, the number of times the drum 14 has been recycled, stored in the auxiliary memory 17 of the drum unit 15 (see FIG. 12) is not 00, it means that the drum unit 15 was replaced with a recycled one (YES at step S5). In this case, steps S4, S11, and S12 are executed.

If the drum unit 15 is not replaced and the engine controller 36 was replaced with a new one because of breakage, etc., (YES at step S6), the N31, the serial number of the main body of the apparatus, stored in the flash ROM 40 of the newly mounted engine controller 36 (see FIG. 13) is 00. Then, the N31, the serial number of the main body of the apparatus, and the N32, the total number of print sheets counted since the main body of the apparatus was a new product (see FIG. 12), are read from the auxiliary memory 17 and are written into the flash ROM 40 of the engine controller 36 to set the same values as the N31 and N32 stored in the auxiliary memory 17 at step S7.

The difference between the N32, the total number of print sheets counted since the main body of the apparatus was a new product, and the N33, the total number of print sheets counted since the main body of the apparatus was a new product when the developing unit 20 is replaced with a new product and the difference between the N32 and the N34, the total number of print sheets counted since the main body of the apparatus was a new product when the fixing unit 30 is replaced with a new product, stored in the auxiliary memory 17 (see FIG. 12) are found and stored in the flash ROM 40 as the N37, the number of print sheets using the developing unit 20, and the N38, the number of print sheets using the fixing unit 30, at step S8.

If the N31, the serial number of the main body of the apparatus, stored in the auxiliary memory (see FIG. 12) does not match the N31, the serial number of the main body of the apparatus, stored in the flash ROM 40 (see FIG. 13) at step S9, the N31, the serial number of the main body of the apparatus, and the N32, the total number of print sheets, are read from the flash ROM 40 and are written into empty entries in the auxiliary memory 17 at step S10.

If such an event is repeated and the auxiliary memory fills with information, the information is rewritten in order starting at the oldest storage contents.

In doing so, if a drum unit 15 or an engine controller 36 of another printer 10 is inserted for some reason on the market, its history can be left in the auxiliary memory 17.

By the way, to replace the drum unit 15 with another one because of a scratch of the drum 14, etc., the cumulative number of print sheets the drum 14 has printed is stored in the auxiliary memory 17 of the drum unit 15 taken out from the main body of the apparatus. Thus, the number of print sheets is read and for example, if it is less than 50,000, the drum 14 can be recycled; if the number of print sheets is equal to or greater than 50,000, the drum 14 can be discarded.

Figure 12:
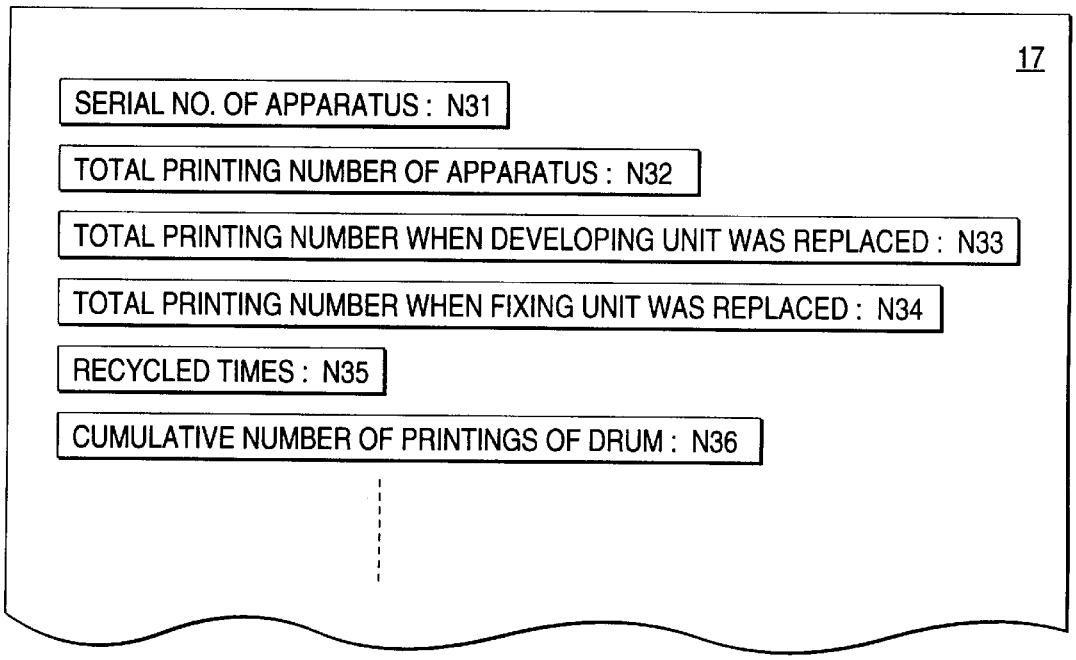
FIG. 12 is a drawing to schematically show the storage contents of an auxiliary memory of a drum unit according to the third embodiment.

As shown in FIG. 12, the N35, the number of times the drum 14 has been recycled, is stored in the auxiliary memory 17, so that recycling of the once recycled drum 14 can be stopped or that the once recycled drum 14 can be recycled more than once.

If the same data is stored in at least three entries in the auxiliary memory 17, even if power is turned off while data is being written and the data being written is broken, accurate data can also be determined under majority rule of the data pieces.

Although the number of sheets of paper, for example, 50,000, is used as the determination criterion as to whether or not the drum 14 can be recycled in the embodiment, any other number of sheets of paper can also be used as the determination criterion, needless to say.

Further, the guaranteed number of sheets of paper is, for example, 300,000 in the embodiment, but need not be limited to 300,000, needless to say.

As we have discussed, according to the invention, the cumulative number of print sheets of paper the photosensitive body has printed is stored in the auxiliary memory of the photosensitive unit, so that the auxiliary memory of the photosensitive unit removed by replacement is read and whether or not the photosensitive body in the photosensitive unit is still recyclable can be easily determined based on the cumulative number of print sheets of paper the photosensitive body has printed.

Even if the main body controller is electrically destroyed, the total number of print sheets of paper counted since the main body of the apparatus was a new product is also stored in the auxiliary memory of the photosensitive unit and thus is stored in the main memory of a new main body controller mounted by replacement, whereby calculation for guaranteeing the number of print sheets of paper can be executed although the main body controller is replaced.

Since the identification of the main body of the apparatus and the total number of print sheets of paper counted since the main body of the apparatus was a new product are stored in the main memory of the main body controller, they can also be stored in the auxiliary memory of a new photosensitive unit mounted by replacement.

Further, according to the embodiment, the number of times the drum has been recycled can be stored in the auxiliary memory 17, thus the auxiliary memory 17 of a new drum unit 15 mounted by replacement can be read for easily determining whether the drum 14 in the new drum unit 15 is a new product or a recycled product and whether or not the drum 14 in the drum unit 15 removed by replacement is still recyclable.

Since the identification of the main body of the apparatus and the value resulting from incrementing the total number of print sheets of paper counted since the main body of the apparatus was a new product each time a sheet of paper is printed are stored in the main memory of the main body controller, they can also be stored in the auxiliary memory of a new photosensitive unit mounted by replacement.

When the image formation unit other than the photosensitive unit is replaced with a new product, the total number of print sheets counted so far since the main body of the apparatus was a new product is stored in the auxiliary memory of the photosensitive unit as a constant value not incremented as the later printing is performed. Thus, if the main body controller is replaced with a new one and the value of the number of print sheets using the image formation unit stored in the auxiliary memory is lost, the number of print sheets using the image formation unit after the replacement is calculated as the difference between the value resulting from incrementing the total number of print sheets of paper counted since the main body of the apparatus was a new product each time a sheet of paper is printed and the constant value of the total number of print sheets counted since the main body of the apparatus was a new product at the replacement time of the image formation unit and the difference is written into the main memory of the new main body controller, whereby the value resulting from incrementing the number of print sheets using the image formation unit each time a sheet of paper is printed can be restored and life management of the image formation unit can be continued.

According to the embodiment, the number of times the drum has been recycled can be stored in the auxiliary memory and thus the auxiliary memory of a new drum unit mounted by replacement is read, whereby whether or not the drum is a new product or a recycled product can be determined easily and whether or not the drum in the drum unit removed by replacement can be recycled can be determined easily.

Further, the number of print sheets using the developing unit, and the number of print sheets using the fixing unit are stored and whether or not they reach predetermined values is determined, whereby the lives of the developing unit and the fixing unit can be determined easily.

What is claimed is:

1. An image formation apparatus comprising:

a main body of said apparatus;

a photosensitive unit having a photosensitive body and a device for acting on the photosensitive body, said photosensitive unit being disposed detachably in said main body of said apparatus; and a main body controller for controlling operation of components for performing image formation operation using the photosensitive body, said main body controller having a main memory for storing predetermined items, wherein a recyclable substance is used for the photosensitive body and said photosensitive unit is provided with an auxiliary memory, and a cumulative number of print sheets of paper the photosensitive body has printed and a total number of print sheets of paper counted over a life of the main body of said apparatus are stored in both the main memory and the auxiliary memory.

2. The image formation apparatus as claimed in claim 1, wherein when said photosensitive unit is replaced with another photosensitive unit, the total number of print sheets of paper counted over the life of the main body of said apparatus, stored in the main memory are stored in an auxiliary memory of the other photosensitive unit with which said photosensitive unit is replaced.

3. The image formation apparatus as claimed in claim 1, wherein when said main body controller is replaced with another main body controller, the cumulative number of print sheets of paper the photosensitive body has printed and the total number of print sheets of paper counted over the life of the main body of said apparatus, stored in the auxiliary memory are stored in a main memory of the other main body controller with which said main body controller is replaced.

4. The image formation apparatus as claimed in claim 1, wherein a number of times the photosensitive body has been recycled is stored in the auxiliary memory.

5. The image formation apparatus as claimed in claim 4, wherein whether or not the photosensitive body is to be recycled is determined based on either or both of the number of times the photosensitive body has been recycled and the cumulative number of print sheets of paper the photosensitive body has printed.

6. An image formation apparatus comprising:

a main body of said image formation apparatus;

a photosensitive unit having a photosensitive body and a device for acting on the photosensitive body, said photosensitive unit being disposed detachably in said main body of said apparatus; and a main body controller for controlling operation of components for performing image formation operation using the photosensitive body, said main body controller having a main memory for storing predetermined items, wherein a recyclable substance is used for the photosensitive body and said photosensitive unit is provided with an auxiliary memory, an identification of the main body of said apparatus and a total number of print sheets of paper counted over a life of the main body of said apparatus are stored in the main memory and the auxiliary memory, and a cumulative number of print sheets of paper the photosensitive body has printed is further stored in the auxiliary memory.

7. The image formation apparatus as claimed in claim 6, wherein when said photosensitive unit is replaced with another photosensitive unit, the identification of the main body of said apparatus and the total number of print sheets of paper counted over the life of the main body of said apparatus, stored in the main memory are stored in an auxiliary memory of the other photosensitive unit with which said photosensitive unit is replaced.

8. The image formation apparatus as claimed in claim 6, wherein when said main body controller is replaced with another main body controller, the identification of the main body of said apparatus and the total number of print sheets of paper counted over the life of the main body of said apparatus, stored in the auxiliary memory are stored in a main memory of the other main body controller mounted with which said main body controller is replaced.

9. The image formation apparatus as claimed in claim 6, wherein the number of times the photosensitive body has been recycled is stored in the auxiliary memory.

10. The image formation apparatus as claimed in claim 9, wherein whether or not the photosensitive body is to be recycled is determined based on at least one of the number of times the photosensitive body has been recycled and the cumulative number of print sheets of paper the photosensitive body has printed.

11. An image formation apparatus comprising:

a main body of said image formation apparatus;

a photosensitive unit having a photosensitive body and a device for acting on the photosensitive body, said photosensitive unit being disposed detachably in said main body of said apparatus;

an image formation unit being disposed detachably in said main body of said apparatus for performing image formation operation together with said photosensitive unit; and a main body controller for controlling operation of components for performing image formation operation using said photosensitive unit and said image formation unit, said main body controller having a main memory for storing predetermined items, wherein a recyclable substance is used for the photosensitive body and said photosensitive unit is provided with an auxiliary memory, and an identification of the main body of said apparatus and a value resulting from incrementing a total number of print sheets of paper counted during use of the main body of said apparatus, the value incremented each time a sheet of paper is printed are stored in the main memory and the auxiliary memory, a value resulting from incrementing a cumulative number of print sheets of paper the photosensitive body has printed is stored in the auxiliary memory, and a value resulting from incrementing at least one of time and a number of print sheets using said image formation unit each time a sheet of paper is printed is stored in the main memory to measure a life of said image formation unit.

12. The image formation apparatus as claimed in claim 11, wherein when said photosensitive unit is replaced with another photosensitive unit, the identification of the main body of said apparatus and the value resulting from incrementing the total number of print sheets of paper counted over the life of the main body of said apparatus each time a sheet of paper is printed, stored in the main memory are stored in an auxiliary memory of the other photosensitive unit with which said photosensitive unit is replaced.

13. The image formation apparatus as claimed in claim 11, wherein when said main body controller is replaced with another main body controller, the identification of the main body of said apparatus and the value resulting from incrementing the total number of print sheets of paper counted over the life of the main body of said apparatus each time a sheet of paper is printed, stored in the auxiliary memory are stored in a main memory of the other main body controller mounted with which said main body controller is replaced.

14. The image formation apparatus as claimed in claim 11 wherein the number of times the photosensitive body has been recycled is stored in the auxiliary memory.

15. The image formation apparatus as claimed in claim 14 wherein whether or not the photosensitive body is to be recycled is determined based on at least one of the number of times the photosensitive body has been recycled and the cumulative number of print sheets of paper the photosensitive body has printed, stored in the auxiliary memory.

16. The image formation apparatus as claimed in claim 11, wherein when said image formation unit is replaced with a new product, at least one of the value of the time and the number of print sheets using said image formation unit before replacement, stored in the main memory, is erased and the total number of print sheets counted over the life of the main body of the apparatus to that point in time is stored in the auxiliary memory as a constant value not incremented as later printing is performed.

* * * * *